US007589469B2

(12) United States Patent
Soga et al.

(10) Patent No.: US 7,589,469 B2
(45) Date of Patent: Sep. 15, 2009

(54) COAXIAL WAVEGUIDE CONVERTER CIRCUIT FOR TRAVELING-WAVE TUBE, METHOD OF MANUFACTURING SAME, AND WAVEGUIDE MATCHING PART FOR USE IN COAXIAL WAVEGUIDE CONVERTER CIRCUIT

(75) Inventors: Kazuhito Soga, Sagamihara (JP); Akihiko Nemoto, Sagamihara (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 33 days.

(21) Appl. No.: 11/779,772

(22) Filed: Jul. 18, 2007

(65) Prior Publication Data

US 2008/0024251 A1 Jan. 31, 2008

(30) Foreign Application Priority Data

Jul. 25, 2006 (JP) ..... 2006-201882

(51) Int. Cl.
*H01J 23/50* (2006.01)
*H01P 5/103* (2006.01)

(52) U.S. Cl. ..... 315/39.3; 333/26; 333/34

(58) Field of Classification Search ..... 333/26, 333/34; 315/39.3
See application file for complete search history.

(56) References Cited

U.S. PATENT DOCUMENTS 2,845,570 A * 7/1958 Klein ..... 315/3.5
3,432,716 A * 3/1969 Tanaka et al. ..... 315/3.5

FOREIGN PATENT DOCUMENTS

JP 2-32208 U 2/1990
JP 2005-339892 A 12/2005

* cited by examiner

*Primary Examiner*—Benny T. Lee
(74) *Attorney, Agent, or Firm*—Sughrue Mion, PLLC

(57) ABSTRACT

A coaxial waveguide converter circuit is provided for converting an input/output coaxial section of a traveling-wave tube to a waveguide. The circuit comprises a waveguide matching part for connecting an inner conductor of the coaxial section extending into the waveguide to a wall of the waveguide. The waveguide matching part includes a fitting hole for fitting the inner conductor thereinto, and a plurality of cantilever supports which define the fitting hole at leading end portions thereof. The leading end portions of the plurality of cantilever supports defining the fitting hole are uniformly kept in close contact with a peripheral surface of the inner conductor.

10 Claims, 7 Drawing Sheets

COAXIAL WAVEGUIDE CONVERTER CIRCUIT FOR TRAVELING-WAVE TUBE, METHOD OF MANUFACTURING SAME, AND WAVEGUIDE MATCHING PART FOR USE IN COAXIAL WAVEGUIDE CONVERTER CIRCUIT

This application is based upon and claims the benefit of priority from Japanese patent application No. 2006-201882, filed on Jul. 25, 2006, the disclosure of which is incorporated herein in its entirety by reference.

BACKGROUND OF THE INVENTION

1. Field of the Invention

The present invention relates to an input/output section of a traveling-wave tube for amplifying microwaves. In particular, the present invention relates to the structure of a coaxial waveguide converter circuit for converting the mode of the microwave when a microwave is applied from a waveguide to an input coaxial section of a traveling-wave tube, or for converting the mode of the microwave when a microwave is delivered from an output coaxial section of the traveling-wave tube to the waveguide.

2. Description of the Related Art

FIG. 1 is a longitudinal sectional view schematically illustrating the configuration of a general traveling-wave tube disclosed in Japanese laid-open patent publication No. 2005-339892A. Traveling-wave tube 100 generally comprises electron gun 101, delay circuit 102, and collector 103. Delay circuit 102 comprises helix 105 securely supported by dielectric 106 within vacuum sheath 104. Delay circuit 102 comprises, at both ends thereof, input circuit 107 for applying a microwave to helix 105 within traveling-wave tube 100, and output circuit 108 for delivering a microwave which is amplified while it propagates through helix 105, respectively. When waveguides 109 are used in input circuit 107 and output circuit 108, a coaxial waveguide converter circuit is formed between waveguides 109 and input/output coaxial sections 110 of traveling-wave guide 100 for converting the mode of the microwave.

A structure as shown in Japanese utility model publication No. H02-32208 has been proposed for the coaxial waveguide converter circuit. As illustrated in FIG. 2, this structure comprises cylindrical coaxial outer conductor 203 which couples waveguide 201 with outer sheath 202 of a traveling-wave tube, and coaxial inner conductor 205 which extends within waveguide 201 along the center axis of coaxial outer conductor 203 from outer sheath 202 of the traveling-wave tube to connect helix 204 to waveguide 201. Furthermore, a gap between coaxial outer conductor 203 and coaxial inner conductor 205 is sealed by ceramic window 206 under vacuum. In addition, waveguide matching part 207 is used at the joint of coaxial inner conductor 205 and waveguide wall 201*a* for impedance matching of a coaxial section comprised of coaxial outer conductor 203 and coaxial inner conductor 205 with waveguide 201.

Waveguide matching part 207, which comprises a cylindrical member, is fitted into a hole formed through waveguide wall 201*a* from the outside of waveguide tube 201 for fixation therein, and cylindrical coaxial inner conductor 205 is fitted into waveguide matching part 207. A cylindrical hole of part 207 has its leading end portion narrower than the remaining portion, such that coaxial inner waveguide 205 is fitted into a narrow hole (hereinafter called "fitting hole 207*a*") at the leading end of part 207. Also, part 207 is made of a resilient material (for example, phosphor bronze), and is formed with a plurality of slits 207*b* from the leading end thereof, as illustrated in FIGS. 3A and 3B.

Before such waveguide matching part 207 is fitted into waveguide 201 from the outside thereof, cantilever supports 207*c*, divided by slits 207*b*, are previously urged toward the center axis (in other words, fitting hole 207*a* is narrowed). By fitting coaxial inner conductor 205 into waveguide matching part 207 in this state, waveguide matching part 207 is brought into contact with coaxial inner conductor 205. The contact between waveguide matching part 207 and coaxial inner conductor 205 is maintained by the resiliency of cantilever support 207*c*.

According to the structure of the above waveguide matching part 207, part 207 can be brought into contact with coaxial inner conductor 205 without requiring a high machining accuracy for part 207, and is also assembled into waveguide 201 with ease.

However, the waveguide matching part of the coaxial waveguide converter circuit as disclosed in Japanese utility model publication No. H02-32208 is configured to make a contact with the coaxial inner conductor by urging the cantilever support to narrow the coaxial inner conductor fitting hole. As such, when relying on manual operations, the fitting hole is non-uniformly narrowed, resulting in a non-circular fitting hole which is brought into contact with the cylindrical coaxial inner conductor. Consequently, the contact is exacerbated between the coaxial inner conductor and waveguide matching part. On the other hand, when the operation is automated to uniformly narrow the fitting hole, the manufacturing cost is increased.

On the other hand, the coaxial inner conductor fitting hole in the conventional waveguide matching part is a straight hole which has a diameter larger than that of the coaxial inner conductor. Specifically, as illustrated in FIG. 4(*a*), wall surfaces of cantilever supports 207*c* which define fitting hole 207*a* are substantially parallel with the center line of fitting hole 207*a*. Accordingly, when waveguide matching part 207 is brought into contact with coaxial inner conductor 205, with cantilever supports 207*c* being previously urged, the wall surfaces of cantilever supports 207*c* which define fitting hole 207*a* are inclined, causing fitting hole 207*a* to come into point contact with coaxial inner conductor 205, as illustrated in FIG. 4(*b*). This further engraves the problem of the contact when the fitting hole is manually narrowed.

As described above, when the coaxial inner conductor is insufficiently in contact with the waveguide matching part, a problem arises in which the heat dissipation capability from the coaxial inner conductor is reduced.

Specifically, in a traveling-wave tube, as an electron beam passes through the delay circuit, the electron beam impinges on the inner wall of the helix to generate heat. Heat is also generated due to a high frequency loss when a microwave passes through the helix. Such heat generated in the helix is dissipated from the outer sheath of the traveling-wave tube, and is also dissipated from the waveguide through the coaxial inner conductor and waveguide matching part connected to the helix, and the like.

However, when the heat dissipation capability from the coaxial inner conductor is reduced, this causes the temperature to rise in the coaxial section and helix, which results in degraded electric characteristics and instable operations. In the worst case, discharge, sputtering and the like have occasionally occurred in the coaxial section to render the traveling-wave guide defective in operation.

Also, since the temperature rises during the operation of the traveling-wave guide, the contact exacerbates between the coaxial inner conductor and waveguide matching part due to a difference in thermal expansion between respective parts which make up the coaxial waveguide converter circuit, possibly resulting in a further degradation of the heat dissipation effect from the coaxial inner conductor.

SUMMARY OF THE INVENTION

In view of the problems of the related art mentioned above, it is an exemplary object of the present invention to improve contact between a coaxial inner conductor and a waveguide matching part to enhance heat dissipation capabilities over the conventional structure.

A coaxial waveguide converter circuit according to an exemplary embodiment of the present invention comprises a waveguide matching part for connecting the inner conductor of a coaxial section extending into a waveguide to a wall of the waveguide. This part comprises a fitting hole into which the inner conductor is fitted, and a plurality of resilient cantilever supports, the leading end portions of which define the fitting hole. To solve the problems mentioned above, the inner conductor is tapered only in its leading end portion, and an opening of the fitting hole, into which the inner conductor is inserted, has a diameter larger than the diameter of the inner conductor at the extreme leading end thereof, and smaller than the outer diameter of the body of the inner conductor except for the leading end portion. Thus, when the inner conductor is inserted into the fitting hole of the waveguide matching part, each cantilever support uniformly displaces outward in the radial direction of the waveguide matching part in conformity to the outer diameter of the inner conductor, and simultaneously, each cantilever support is kept in good contact with the inner conductor with the aid of resiliency of the cantilever supports.

According to the foregoing configuration, the heat conduction property is improved over the related art when heat is dissipated from the inner conductor to the waveguide through the waveguide matching part. Consequently, the waveguide matching part improves the effect of preventing the temperature from rising in the coaxial section and helix, thus allowing stable operation without causing degraded electric characteristics. In addition, the inner conductor is readily fitted into the waveguide matching part.

Further, the fitting hole of the waveguide matching part that is used is preferably tapered with its diameter being increasingly reduced toward the opening of the fitting hole into which the inner conductor is inserted, and the insertion opening has a diameter smaller than the outer diameter of the inner conductor. The fitting hole includes an opening opposite to the inner conductor insertion opening. The opening is formed with the same diameter as the outer diameter of the inner conductor, thereby allowing each cantilever support to come into plane contact with the inner conductor, when the inner conductor is fitted into the fitting hole. In other words, the heat dissipation capability is further improved.

Also, to solve the problems mentioned above, in the structure according to the other exemplary aspect of the present invention, the waveguide may include a hole formed through its wall for fitting thereinto a portion of the waveguide matching part comprised of the plurality of cantilever supports to fix the portion therein, where the hole is tapered with its diameter being increasingly reduced from the outside to the inside of the waveguide. A waveguide matching part for use in this structure comprises a fitting hole for fitting the inner conductor thereinto, and a plurality of resilient cantilever supports, the leading ends of which define the fitting hole. When the waveguide matching part is inserted into the tapered hole formed through the waveguide wall, each cantilever support displaces inward in the radial direction of the waveguide matching part in conformity with the increasingly reduced diameter of the tapered hole to firmly come into close contact with the inner conductor. Accordingly, this structure can also be expected to improve the heat dissipation capability over the related art.

The above and other objects, features and advantages of the present invention will become apparent from the following description with reference to the accompanying drawings which illustrate examples of the present invention.

DETAILED DESCRIPTION OF THE PREFERRED EMBODIMENTS

Figure 1:
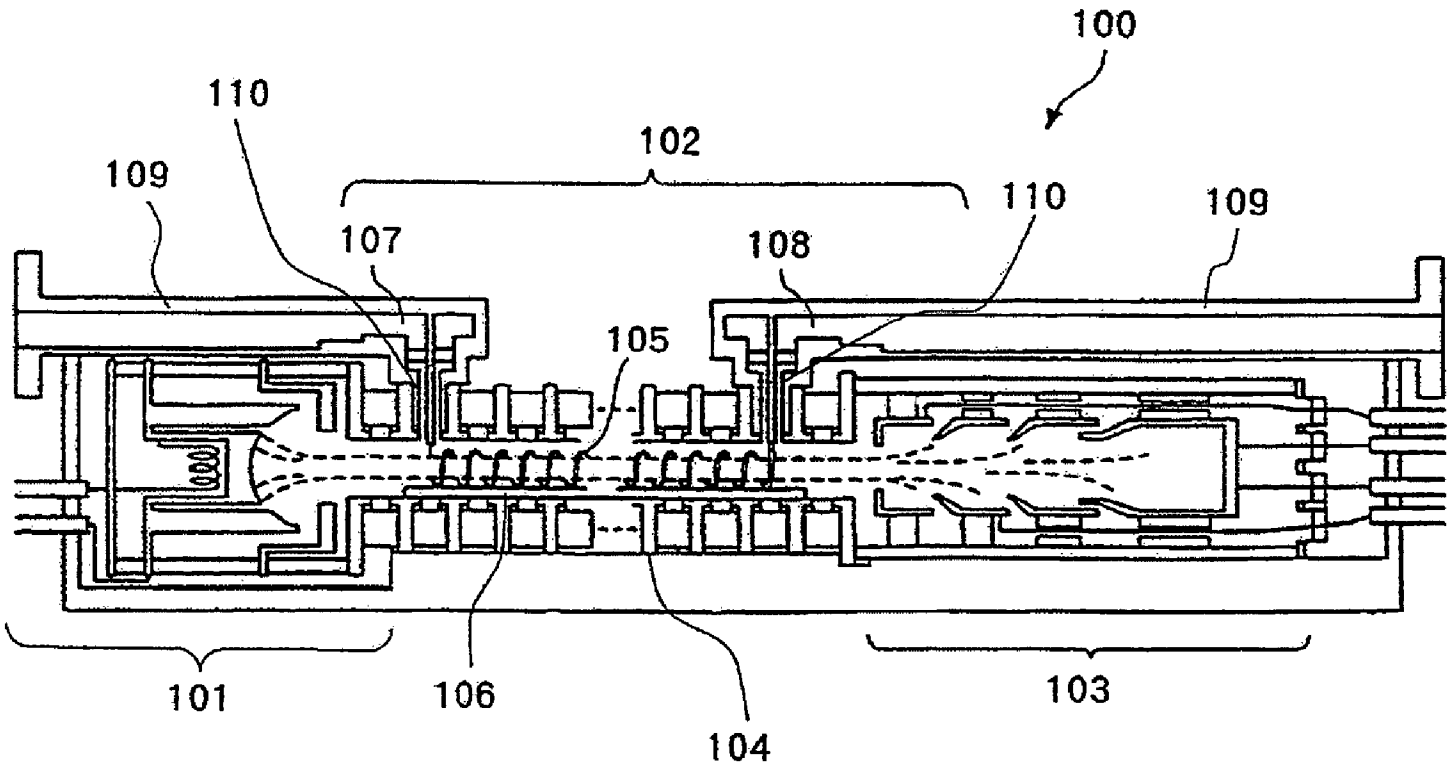
Fig. 1 PRIOR ART
FIG. 1 is a longitudinal sectional view schematically illustrating the configuration of a general traveling-wave tube.
Figure 2:
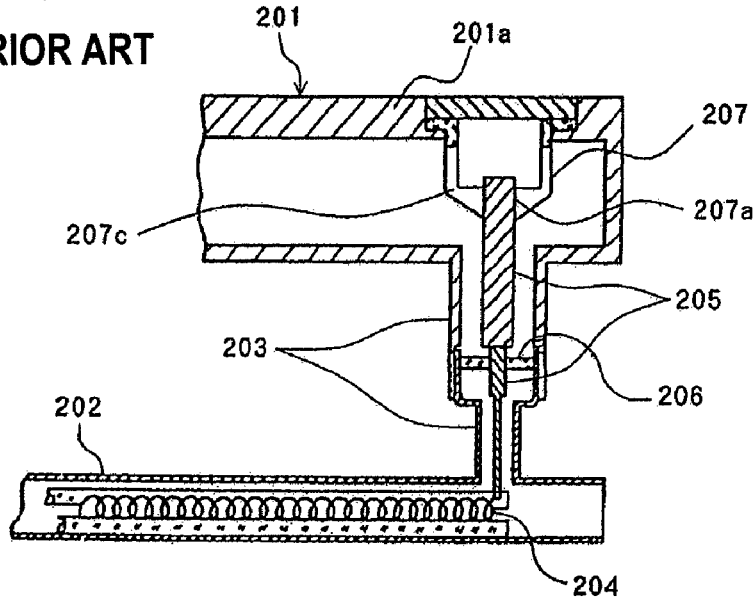
Fig. 2 PRIOR ART
FIG. 2 is a longitudinal sectional view schematically illustrating the configuration of a conventional coaxial waveguide converter circuit for use in a traveling-wave tube.
Figure 3A:
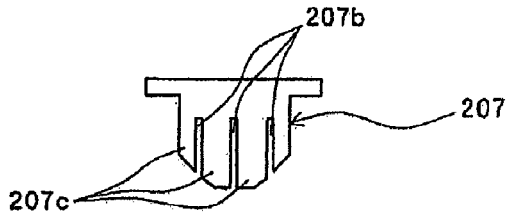
Fig. 3A PRIOR ART
FIG. 3A is a front view illustrating a waveguide matching part shown in FIG. 2, when not assembled.
Figure 3B:
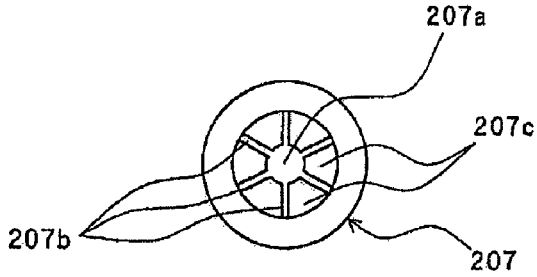
Fig. 3B PRIOR ART
FIG. 3B is a plan view illustrating only the waveguide matching part shown in FIG. 2, when not assembled, viewed from the leading end side (near the traveling-wave guide)

In the following description, the same reference numerals are used to designate the same components as those in the conventional coaxial waveguide converter circuit illustrated in FIG. 2.

First Exemplary Embodiment

A first exemplary embodiment of the present invention will be described with reference to FIGS. 5 and 6. Both FIGS. 5 and 6 illustrate waveguide matching part 207A on a plane taken along a slit.

Figure 5:
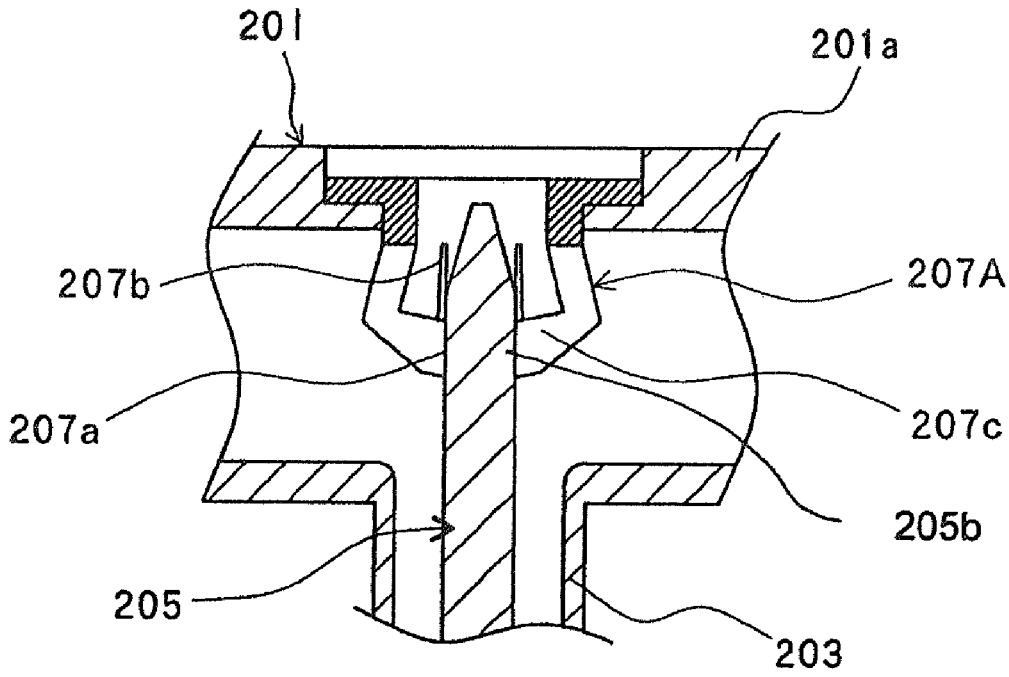
FIG. 5 is a longitudinal sectional view schematically illustrating the configuration of a coaxial waveguide converter circuit for a traveling-wave tube according to a first exemplary embodiment of the present invention.
Figure 6:
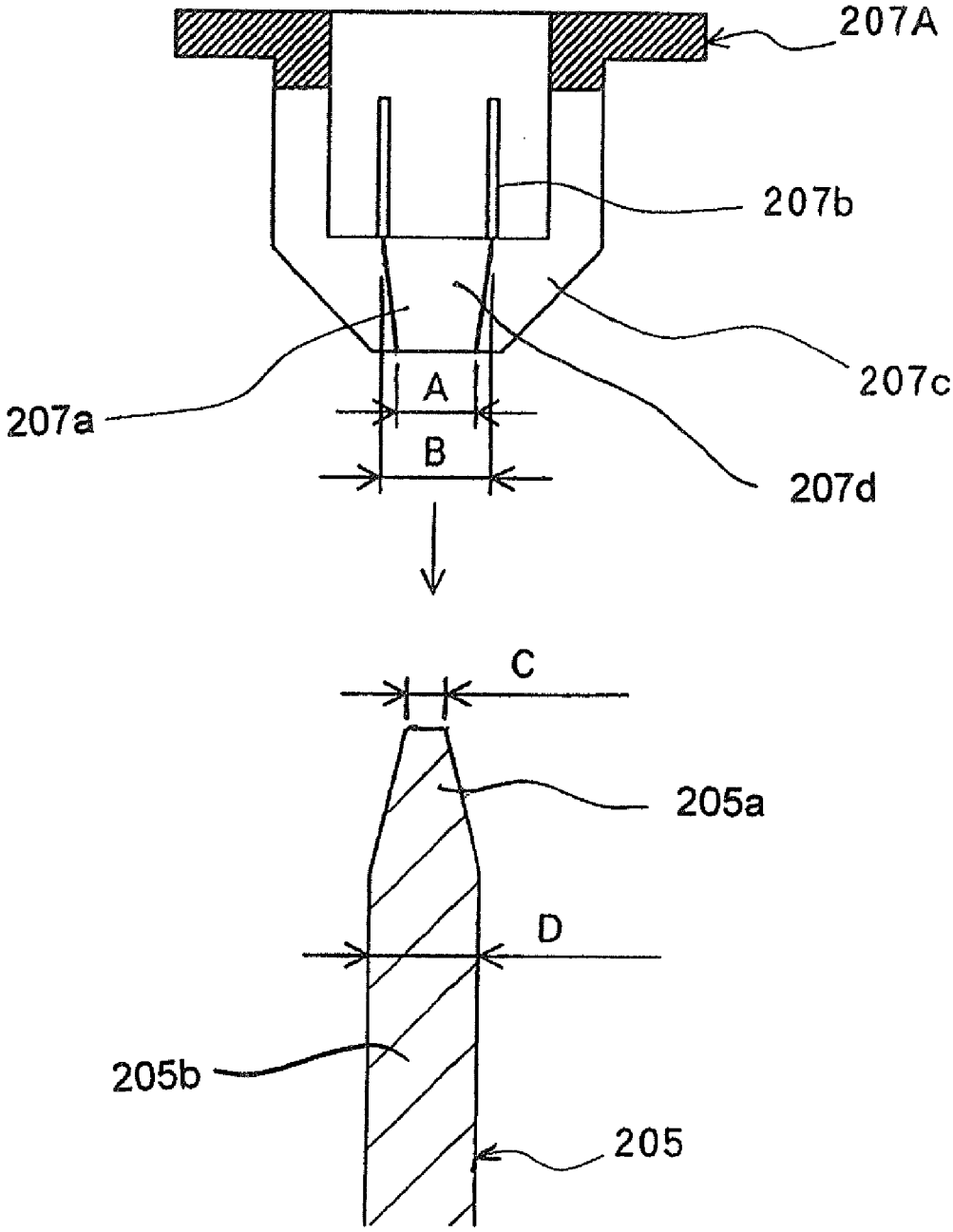
FIG. 6 is a longitudinal sectional view illustrating how a coaxial inner conductor is fitted into a simple waveguide matching part used in the first exemplary embodiment of the present invention.

In FIGS. 5 and 6, a cylindrical conductor is used for the coaxial inner conductor 205. The coaxial inner conductor 205 is fitted into the waveguide matching part 207A of this exemplary embodiment. Specifically, waveguide matching part 207A comprises a cylindrical member which has a cylindrical hole that is narrower only in a leading end portion 207*d* (FIG. 6) of part 207A than in the remaining portion, to define fitting hole 207*a*. In addition, this part 207A is made of a resilient material (for example, phosphor bronze), and is formed with a plurality of slits 207*b* from the leading end thereof. In this way, aided by their resiliency, cantilever supports 207*c*, that are divided by respective slits 207*b*, can displace towards the center axis of fitting hole 207*a*. As illustrated in FIG. 5, when coaxial inner conductor 205 is fitted into fitting hole 207*a* of waveguide matching part 207A, each cantilever support 207*c* aided by its resiliency is in contact with coaxial inner conductor 205. It should be noted that a plurality of cantilever supports 207*c* of waveguide matching part 207A protrude into the inside of waveguide wall 201*a*, and no waveguide wall 201*a* exists around cantilever supports 207*c* (outside of waveguide matching part 207A in the radial direction).

In particular, in this exemplary embodiment, coaxial inner conductor fitting hole 207*a* of waveguide matching part 207A, when coaxial inner conductor 205 is not fitted thereinto, has a tapered circular shape, the diameter of which is gradually reduced toward the leading end 207*d* of part 207A (opening into which coaxial inner conductor 205 is inserted), as illustrated in FIG. 6. Further, leading end portion 205*a* of cylindrical coaxial inner conductor 205, which extends into the waveguide, is tapered with its diameter gradually reduced toward the leading end, or leading end portion 205*a* has its edge chamfered.

Further, as illustrated in FIG. 6, at the leading end 207*d* of waveguide matching part 207A, diameter A of the opening in tapered fining hole 207*a* is smaller than diameter B of an opening in fitting hole 207*a* at the rear end of waveguide matching part 207A. On the other hand, coaxial inner conductor 205 has diameter C at the leading end 205*a* thereof, which is smaller than diameter D of body 205*b* of coaxial inner conductor 205, and which is also smaller than diameter A of the opening of fitting hole 207*a*. In addition, diameter D of body 205*b* of coaxial inner conductor 205 may be larger than diameter B of the opening of fitting hole 207*a*, but preferably diameter D is substantially the same size as diameter B of the opening of fitting hole 207*a*. Stated another way, a relationship D>B>A>C may exist, but preferably D≈B>A>C.

As described above, since fitting hole 207*a* at the leading end 207*d* of waveguide matching part 207A has the opening, the diameter A of which is larger than diameter C at the leading end of coaxial inner conductor 205, and smaller than diameter D of body 205*b* of coaxial inner conductor 205, coaxial inner conductor 205 is readily inserted into fitting hole 207*a* of waveguide matching part 207A. Then, while coaxial inner conductor 205 is being inserted into fitting hole 207*a*, each cantilever support 207*c* deforms in conformity to the outer diameter of coaxial inner conductor 205. Consequently, a good contact can be maintained between waveguide matching part 207A and coaxial inner conductor 205 as best shown in FIG. 5. Specifically, since each cantilever support 207*c* uniformly extends outward in the radial direction of waveguide matching part 207A in conformity to the outer diameter of coaxial inner conductor 205 while coaxial inner conductor 205 is inserted into fitting hole 207*a*, the resiliency of cantilever supports 207*c* can serve to maintain a good contact with coaxial inner conductor 205.

In particular, when diameter D of body 205*b* of coaxial inner conductor 205 is substantially the same as diameter B of the opening of fitting hole 207*a* at the rear end of waveguide matching part 207A, wall surfaces of cantilever supports 207*c* which define fitting hole 207*a* are in contact with the peripheral surface of the body 205*b* of coaxial inner conductor 205, as illustrated in FIG. 5. Stated another way, in this event, they are in plane contact with each other to have a larger contact area which further improves the heat conduction property.

As described above, waveguide matching part 207A can maintain good contact with coaxial inner conductor 205 by simply inserting coaxial inner conductor 205 into fitting hole 207*a*, without the need for a step of previously bending cantilever supports 207*c*, as compared with the conventional counterpart. As a result, the heat conduction property is improved over the related art when heat generated in the helix of the traveling-wave tube is dissipated from coaxial inner conductor 205 to waveguide 201 through waveguide matching part 207A. In addition, waveguide matching part 207A improves the effect of preventing the temperature from rising in the coaxial section and helix, thus allowing stable operation without causing degraded electric characteristics.

Second Exemplary Embodiment

Next, a second exemplary embodiment of the present invention will be described with reference to FIGS. 7 and 8. Both FIGS. 7 and 8 illustrate waveguide matching part 207B on a plane taken along a slit.

Figure 7:
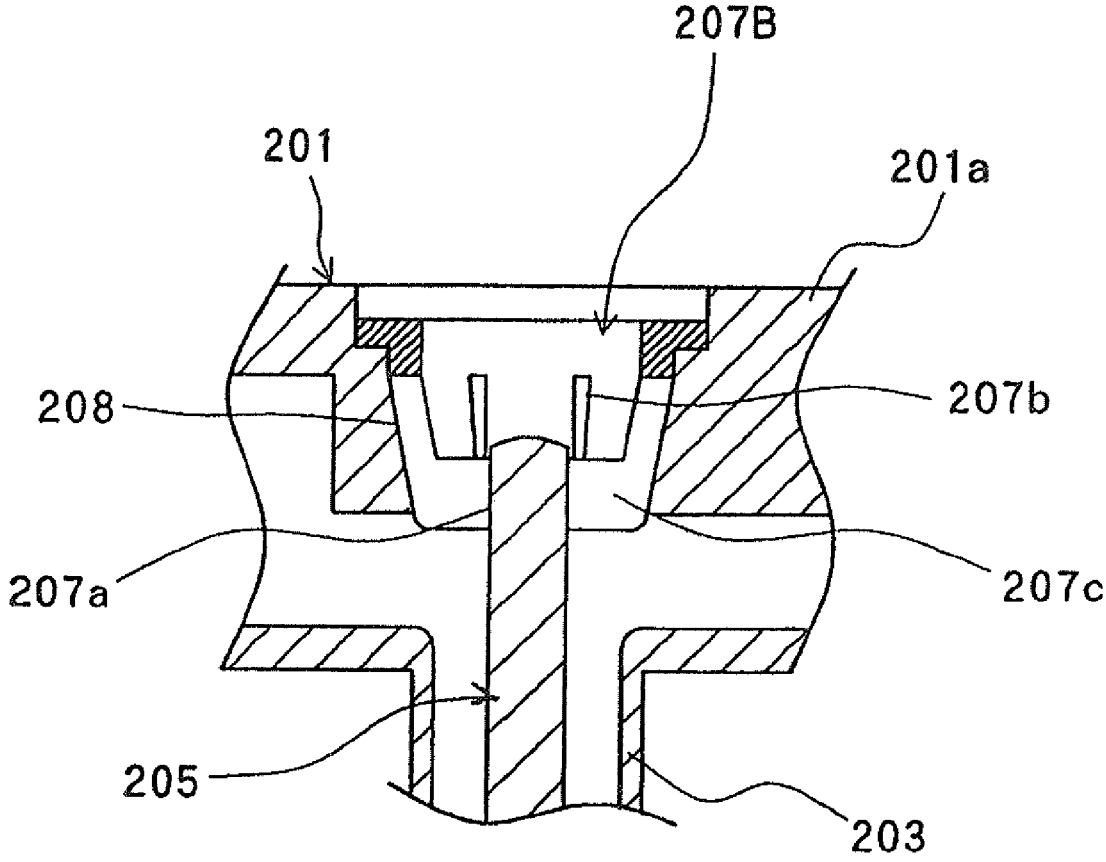
FIG. 7 is a longitudinal sectional view schematically illustrating the configuration of a coaxial waveguide converter circuit for a traveling-wave tube according to a second exemplary embodiment of the present invention.

Likewise, this exemplary embodiment employs cylindrical coaxial inner conductor 205 and a cylindrical coaxial outer conductor 203 (FIG. 7). The waveguide matching part 207B comprises a cylindrical member which has a cylindrical hole that is narrower only at a leading end portion 207*d* (FIG. 8) of part 207B in than the remaining portion, to define fitting hole 207*a*. In addition, this part 207B is made of a resilient material (for example, phosphor bronze), and is formed with a plurality of slits 207*b* from the reading end of part 207B. In this way, aided by their resiliency, cantilever supports 207*c*, that are divided by respective slits 207*b*, can displace towards the center axis of fitting hole 207*a*. It should be noted that slits 207*b* have a width large enough such that the leading end of each cantilever support 207*c* can largely displace toward the center axis of fitting hole 207*a* simultaneously with the other cantilever supports 207*c*.

In particular, in this exemplary embodiment, waveguide matching part 207B is fitted into waveguide wall 201*a* together with a plurality of cantilever supports 207*c*. Then, as illustrated in FIG. 8, hole 208 is formed through waveguide wall 201*a* for inserting thereinto a portion of waveguide matching part 207B, comprised of the plurality of cantilever supports 207*c*. Hole 208 is a tapered circular hole, the diameter of which is increasingly reduced toward the inside of waveguide 201. The outer surface of the portion of waveguide matching part 207B, comprised of the plurality of cantilever supports 207*c*, is also tapered, with its outer diameter being increasingly reduced toward the leading end 207*d* of part 207B (the opening into which coaxial inner conductor 205 is inserted). The angle of the tapered outer surface is designed to be smaller than the angle of tapered hole 208 formed through waveguide wall 201*a*.

Figure 8:
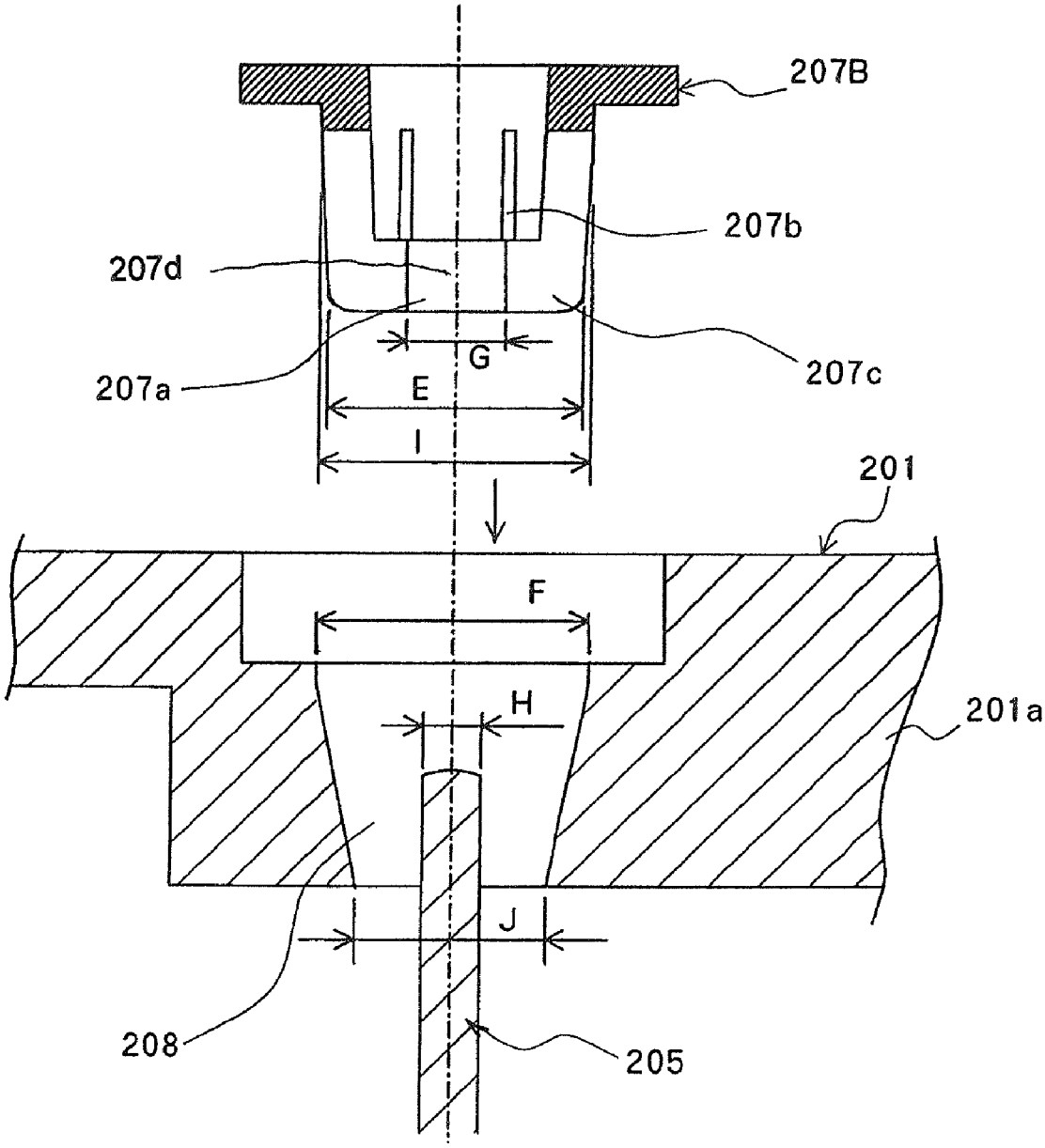
FIG. 8 is a longitudinal sectional view illustrating how a coaxial inner conductor is connected to a waveguide through a waveguide matching part in the second exemplary embodiment of the present invention.

Further, as best shown in FIG. 8, waveguide matching part 207B has outer diameter B at the leading end thereof which is smaller than diameter F of hole 208 open to the outer surface of waveguide wall 201*a*, and larger than diameter J of hole 208 open to the inner surface of waveguide wall 201*a*. In addition, diameter F outside of waveguide wall 201*a* in hole 208 is designed to be slightly larger than the outer diameter I of waveguide matching part 207B at proximal ends of the plurality of cantilever supports 207*c*.

Also, fitting hole 207*a* of waveguide matching part 207B has diameter G which is designed to be larger than diameter H of coaxial inner conductor 205.

By designing waveguide matching part 207B in the foregoing shape, coaxial inner conductor 205 goes into fitting hole 207*a* of waveguide matching part 207B as waveguide matching part 207B is inserted into hole 208 through waveguide wall 201*a*. In this process, the leading end 207*d* of waveguide matching part 207B hits against the side surface of tapered hole 208, causing each cantilever support 207*c* to deform toward the center line of fitting hole 207*a* in conformity to the increasingly reduced diameter of tapered hole 208. In other words, respective cantilever supports 207*c* are urged together inward in the radial direction of waveguide matching part 207B to gradually reduce the diameter of fitting hole 207*a*. Subsequently, when waveguide matching part 207B has been completely inserted into hole 208 of waveguide wall 201*a* as illustrated in FIG. 7, each cantilever support 207*c* is firmly in close contact with coaxial inner conductor 205.

As described above, waveguide matching part 207B does not have the requirement that the cantilever supports 207*c* be previously bent, as compared with the conventional counterpart. In addition, simply by inserting waveguide matching part 207B into tapered hole 208 formed through waveguide wall 201*a* and fixing waveguide matching part 207B in tapered hole 208, close contact is firmly maintained between waveguide matching part 207B and coaxial inner conductor 205. As a result, the heat conduction property is improved over the related art when heat generated in the helix of the traveling-wave tube is dissipated from coaxial inner conductor 205 to waveguide 201 through waveguide matching part 207B. In addition, waveguide matching part 207B improves the effect of preventing the temperature from rising in the coaxial section and helix, thus allowing stable operations without causing degraded electric characteristics.

Figure 4:
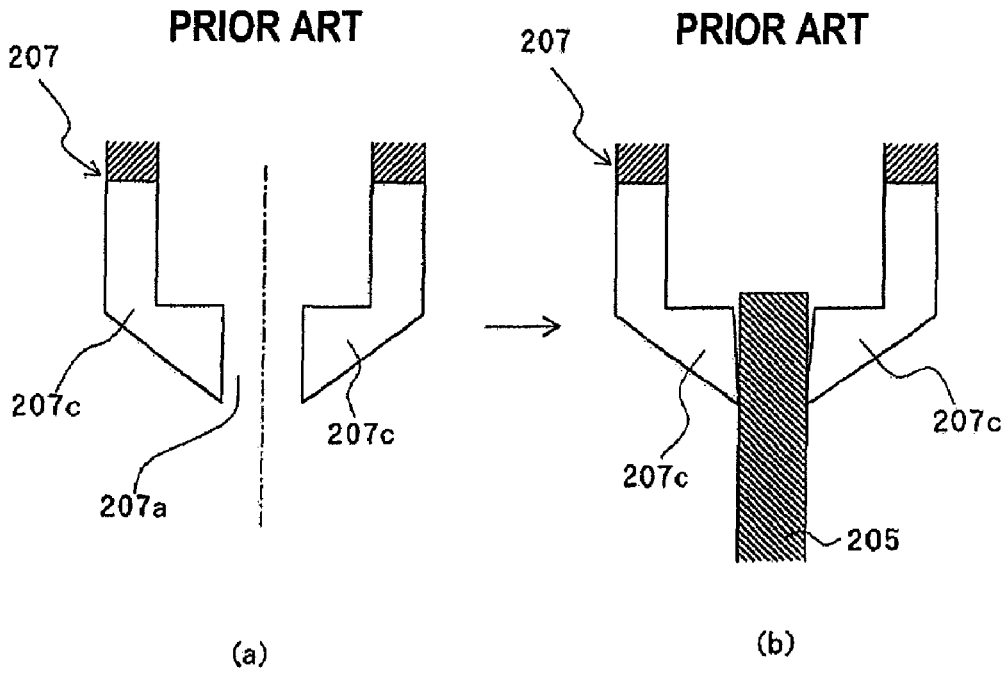
FIG. 4 is a diagram for describing how the waveguide matching part is brought into contact with a coaxial inner conductor, both shown in FIG. 2.

In this exemplary embodiment, the outer surface of waveguide matching part 207B is tapered in the portion comprised of a plurality of cantilever supports 207*c* for the following reason. The tapered outer surface prevents inclination of the wall surfaces of cantilever supports 207*c* which define fitting hole 207*a*, when waveguide matching part 207B is inserted into hole 208 of waveguide wall 201*a*. Accordingly, cantilever supports 207*c* are brought into plane contact with coaxial inner conductor 205. In contrast, when the outer surface of waveguide matching part 207B has the same outer diameter in the portion comprised of the plurality of cantilever supports 207*c*, cantilever supports 207*c* can be brought into point contact with coaxial inner conductor 205, as illustrated in FIG. 4(*b*), when such a waveguide matching part is inserted into hole 208 of waveguide wall 201*a*. In this event, however, a plane contact can be achieved, as described above, by tapering fitting hole 207*a* with its diameter being increasingly reduced toward the direction opposite to the opening into which coaxial inner conductor 205 is inserted.

In any case, each part is preferably designed to prevent cantilever supports 207*c* from coming into point contact with coaxial inner conductor 205. This is because, by designing waveguide matching part 207B in such a way, resulting waveguide matching part 207B further improves the heat dissipation property from coaxial inner conductor 205 to waveguide 201.

As described above, the present invention can improve contact between the coaxial inner conductor and waveguide matching part over the conventional structure. As a result, the present invention can increase the heat dissipation effect from the coaxial inner conductor to stabilize the operation, as compared with the conventional traveling-wave tube.

While exemplary embodiments of the present invention have been described using specific terms, such description is for illustrative purposes only, and it is to be understood that changes and variations may be made without departing from the spirit or scope of the following claims.

What is claimed is:

1. A coaxial waveguide converter circuit for traveling-wave tube, comprising:

a waveguide;

a coaxial section connected to the waveguide;

an inner conductor of said coaxial section that extends into said waveguide, the inner conductor comprising:

a body having a constant outer diameter; and a tapered leading end;

a waveguide matching part attached to a wall of the waveguide, the waveguide matching part comprising a plurality of cantilever supports that are resilient, wherein the cantilever supports are arranged in a circular pattern such that distal ends of said cantilever supports define a fitting hole for fitting the inner conductor therein;

wherein the fitting hole comprises a diameter that is larger than a diameter of the tapered leading end of the inner conductor and smaller than the outer diameter of the body of the inner conductor;

wherein when the inner conductor is inserted into the fitting hole, the tapered leading end of the inner conductor contacts the distal ends of the cantilever supports that form the fitting hole such that the cantilever supports are deflected outward in a radial direction as the tapered leading end passes through the fitting hole; and wherein when the tapered leading end of the inner conductor has passed through the fitting hole, the distal ends of the cantilever supports conform to the outer diameter of the body of the inner conductor, and the distal ends of the cantilever supports remain in contact with the body of the inner conductor due to the resiliency of the cantilever supports.

2. A coaxial waveguide converter circuit for a traveling-wave tube, comprising:

a waveguide;

a coaxial section connected to the waveguide;

an inner conductor of said coaxial section that extends into said waveguide;

a waveguide matching part comprising a plurality of cantilever supports, wherein the cantilever supports are arranged in a circular pattern such that distal ends of the cantilever supports define a fitting hole for fitting the inner conductor therein;

wherein said waveguide comprises a hole disposed through a wall of said waveguide for attaching a portion of said waveguide matching part to the waveguide;

wherein a portion of said hole in the waveguide is tapered with a diameter continuously decreasing in size from a direction of an outside surface of the waveguide to a direction of an inside surface of said waveguide; and wherein when said waveguide matching part is inserted into said hole in the waveguide, said distal ends of said cantilever supports deflect inward in the radial direction of said waveguide matching part to contact said inner conductor.

3. The coaxial waveguide converter circuit for a traveling-wave tube according to claim 2, wherein an outer diameter of the distal ends of the cantilever supports is smaller than a widest diameter of the tapered hole in the waveguide, but larger than a smallest diameter of the tapered hole in the waveguide.

4. A waveguide matching part for connecting an inner conductor to a waveguide of a traveling-wave tube, said waveguide matching part comprising:

a plurality of resilient cantilever supports, wherein distal ends of said cantilever supports define a fitting hole for fitting the inner conductor therein;

wherein the fining hole comprises a distal opening, which the inner conductor is first inserted into, and a proximal opening opposite the distal opening;

wherein said fining hole is tapered with a diameter of the fitting hole decreasing from the proximal opening to the distal opening, and wherein said distal opening of the fitting hole has a diameter smaller than an outer diameter of said inner conductor.

5. The waveguide matching part according to claim 4, wherein said diameter of the fining hole at the proximal opening is the same as the outer diameter of said inner conductor.

6. A method of manufacturing a coaxial waveguide converter circuit of a traveling-wave tube said method comprising:

providing a waveguide;

providing a coaxial section connected to the waveguide;

providing an inner conductor inside of the coaxial section, the inner conductor extending into the waveguide and comprising a body and a tapered leading end;

providing a waveguide matching part for connecting said inner conductor to a wall of said waveguide wherein the waveguide matching part is provided with a plurality of cantilever supports that are resilient such that distal ends of the cantilever supports define a fitting hole for fitting the inner conductor therein; and fixing said waveguide matching part on the wall of said waveguide;

wherein said fitting hole is provided with a distal opening, which the inner conductor is first inserted into, the distal opening having a diameter larger than a diameter of said inner conductor at the leading end, and smaller than an outer diameter of the body of said inner conductor; and inserting said inner conductor into said fitting hole of said waveguide matching part such that the leading end of the inner conductor contacts the distal ends of the cantilever supports causing the distal ends of the cantilever supports to deflect outward in a radial direction of said waveguide matching part;

wherein when the leading end of the inner conductor passes through the distal opening, the cantilever supports conform to the outer diameter of the body of the inner conductor and the cantilever supports remain in contact with the inner conductor due to the resiliency of the cantilever supports.

7. The method of manufacturing a coaxial waveguide converter circuit according to claim 6, further comprising tapering said fitting hole by decreasing a diameter of the fitting hole from a proximal opening to the distal opening.

8. The method of manufacturing a coaxial waveguide converter circuit according to claim 7, wherein the proximal opening of said fitting hole has the same diameter as the outer diameter of said inner conductor.

9. A method of manufacturing a coaxial waveguide converter circuit for a traveling wave tube, the method comprising:

providing a waveguide;

providing a coaxial section connected to the waveguide;

providing an inner conductor inside of the coaxial section, the inner conductor extending into the waveguide;

providing said waveguide with a hole through a wall of said waveguide, wherein a portion of the hole is tapered with a diameter continuously decreasing from a direction of an outside surface of the waveguide to a direction of an inside surface of said waveguide; and providing a waveguide matching part for connecting said inner conductor to a wall of said waveguide wherein the waveguide matching part is provided with a plurality of cantilever supports such that distal ends of the cantilever supports define a fining hole for fining the inner conductor therein;

inserting said inner conductor into said fining hole of said waveguide matching part, while simultaneously fitting said waveguide matching part into said tapered hole from the outside of said waveguide, the tapered hole causing the distal ends of said cantilever supports to deflect inward in a radial direction of said waveguide matching part such that the distal ends of the cantilever supports contact said inner conductor.

10. The method of manufacturing a coaxial waveguide converter circuit according to claim 9, wherein an outer diameter of the distal ends of the cantilever supports is smaller than a widest diameter of the tapered hole in the waveguide, but larger than a smallest diameter of the tapered hole in the waveguide.

* * * * *